United States Patent [19]

Chibana et al.

[11] 3,994,195

[45] Nov. 30, 1976

[54] ELECTRONIC MUSICAL INSTRUMENT

[75] Inventors: Masanobu Chibana; Tsuyoshi Futamase, both of Hamamatsu, Japan

[73] Assignee: Nippon Gakki Seizo Kabushiki Kaisha, Japan

[22] Filed: Nov. 11, 1975

[21] Appl. No.: 630,864

[30] Foreign Application Priority Data

Nov. 15, 1974 Japan ..... 49-131780

[52] U.S. Cl. ..... 84/1.24; 84/DIG. 4; 84/1.03

[51] Int. Cl.[2] ..... G10H 1/02

[58] Field of Search ..... 84/1.01, 1.03, 1.11, 84/1.19, 1.22, 1.24, DIG. 4, 1.23

[56] References Cited

UNITED STATES PATENTS

| | | | |
|---|---|---|---|
| 3,809,786 | 5/1974 | Deutsch | 84/1.03 X |
| 3,809,788 | 5/1974 | Deutsch | 84/1.03 X |
| 3,809,790 | 5/1974 | Deutsch | 84/1.01 |
| 3,809,792 | 5/1974 | Deutsch | 84/1.24 |
| 3,910,150 | 10/1975 | Deutsch et al. | 84/1.03 |

*Primary Examiner*—Ulysses Weldon

*Attorney, Agent, or Firm*—Ladas, Parry, Von Gehr, Goldsmith & Deschamps

[57] ABSTRACT

An electronic musical instrument capable of producing a multi-system tone source effect which is an effect providing a musical tone with naturalness and resulting from simultaneous playing of a tone of a proper pitch and a tone of a pitch slightly different from the proper pitch. The inventive electronic musical instrument produces this effect with a smaller number of tone source devices than the number of systems. .

Composite musical tone waveshape amplitudes achieving the multi-system tone source effect can be represented by a single multiplication term of a sine waveshape function content corresponding to a certain pitch and a cosine waveshape function content corresponding to a pitch difference. According to the invention, the sine waveshape function content and the cosine waveshape function content are separately produced and these contents are multiplied with each other to produce the composite musical tone waveshape amplitudes. An embodiment in which the two contents can be added together by expressing them in logarithm is also described.

4 Claims, 2 Drawing Figures

ELECTRONIC MUSICAL INSTRUMENT

BACKGROUND OF THE INVENTION

This invention relates to an electronic musical instrument capable of producing a multi-system tone source effect.

If a certain musical tone is always played with a constant pitch in an electronic musical instrument, it will give an impression of monotonousness to the audience and therefore is not desirable. Such monotonousness can be eliminated if tones which are slightly different in pitch from each other are simultaneously reproduced from plural tone sources. An effect produced by such simultaneous reproduction of plural tones is hereinafter referred to as "a multi-system tone source effect". In the prior art electronic musical instrument, a tone source device must be provided in each of the systems, if such multi-system tone source effect is to be produced. This inevitably requires a bulky and complicated construction. Particularly, the number of required tone source devices increases as the number of the systems increases with resulting sacrifice of compactness and increase in the manufacturing cost.

SUMMARY OF THE INVENTION

It is, therefore, an object of the present invention to provide an electronic musical instrument capable of producing the multi-system tone source effect with a smaller number of tone source devices than the number of the systems.

The basic principle of the present invention will now be described.

According to the invention, a composite musical tone waveshape amplitude which realizes a two-system tone source effect is obtained by the following formula:

$$Xc = 2An \text{ Sin } n\omega_o t \cos n \frac{\Delta\omega_o}{2} t \qquad (1)$$

where $\omega_o$ represents angular velocity of fundamental frequency, $n$ order of harmonic, An amplitude coefficient of the harmonic of the order $n$, $t$ time, $Xc$ amplitude value of a composite waveshape at the time $t$ (i.e. phase) of the harmonic waveshape of the degree $n$, and $\Delta\omega_o 12$ a slight difference in the angular velocity corresponding to a slight pitch difference. As will be apparent from this formula, the synthetic waveshape amplitude value consists of a multiplication term of sine wave function content (basic content) sin $n\omega_o t$ corresponding to a certain pitch and cosine wave function content (difference content) corresponding to the pitch difference.

In contrast, the prior art electronic musical instrument produces a musical tone by combining two systems of tones which are slightly different in pitch from each other as shown by the following formula:

$$Xc = An \sin n(\omega_o - \frac{\Delta\omega_o}{2})t + \sin n(\omega_o + \frac{\Delta\omega_o}{2}) + \qquad (2)$$

The synthetic amplitude value Xc obtained by the formula (1) is substantially equal to that obtained by the formula (2). They are however different in their organization from each other. More specifically, if a multi-system tone source apparatus is to be constructed without modifying the formula (2), a sine waveshape must be obtained by subtracting the slight difference in the angular velocity from the angular velocity $\omega_o t$ in one system whereas a sine wave must be obtained by adding the slight difference in the angular velocity to the angular velocity $\omega_o t$ in the other system and then sine waveshapes of the two systems must be added together to form the desired musical tone.

According to the formula (1), however, a sine waveshape of a basic pitch (basic content) is obtained in one tone source device, a cosine waveshape (difference content) corresponding to the slight difference in the angular velocity $\Delta\omega_o/2$ (pitch difference) in the other tone source device and the sine waveshape and the cosine waveshape are multiplied with each other. It will be noted from the above description that the tone source apparatus according to the invention is considerably simplified as compared with the prior art instrument.

Another advantage of the invention is that the formula (1) can be readily transformed into a logarithmic expression since the formula is constituted of a single multiplication term. That is, the formula (1) can be transformed into a formula $$\log Xc = \log 2 + \log An + \log \sin n\omega_o t \; 30 \log \cos n \frac{\Delta\omega_o}{2} t \qquad (3)$$

In the above formula (3), the multiplication of the sine waveshape (basic content) and the cosine waveshape (difference content) in the formula (1) is replaced by addition of the two waveshapes. This contributes to simplification of the construction of the tone source device in a digital type electronic musical instrument, because an adder can be made much more compact than a multiplicator.

It is, therefore, a feature of the present invention to divide a composite waveshape with a multi-system effect into a basic content and a difference content and constitute a simple tone source device for each of the contents.

According to the invention, the multi-system tone source effect increases as the number of the employed systems increase. For example, a composite musical tone waveshape amplitude capable of achieving a four system tone source effect is obtained by the following formula (4):

$$Xc = 4An \sin n\omega_o t \cos n \frac{3\Delta\omega_o}{8} t \cos \frac{n\Delta\omega_o t}{8} \qquad (4)$$

where $3\Delta\omega_o/8$ and $\Delta\omega_o/8$ are small angular velocities corresponding to pitch differences and the other symbols represent the same contents as those used in the formula (1).

That is, the composite waveshape amplitude is represented by a single multiplication term constituted of a basic content sin $n\ \omega_o t$ and a differences content $$\cos n \frac{3\Delta\omega_o}{8} t, \cos n \frac{\Delta\omega_o t}{8}.$$

In contrast, in the prior art apparatus, tones of four system which are different in pitch from each other must be synthesized together as shown by the following formula (5):

$$Xc = An[\sin n(\omega_o - \frac{\Delta\omega_o}{2})t + \sin n(\omega_o + \frac{\Delta\omega_o}{2})t + \sin n(\omega_o - \frac{\Delta\omega_o}{4})t + \sin n(\omega_o + \frac{\Delta\omega_o}{4})t \quad (5)$$

where $\Delta\omega_o/2$ and $\Delta\omega_o/4$ are slight differences in the angular velocity corresponding to amounts of the pitch differences relative to a certain pitch. The difference content in the formula (4) is a cosine function content corresponding to the amounts of the pitch differences but not the amounts of the pitch differences themselves.

The above formula (4) can be logarithmically expressed by the following formula (6):

$$\log Xc = \log 4 + \log An + \log \sin n\omega_o t + \log \cos n \frac{3\Delta\omega_o}{8} t + \log \cos n \frac{\Delta\omega_o}{8} t \quad (6)$$

In the above described manner, the invention only requires forming of two cosine waveshapes (i.e. difference contents) besides a sine waveshape (basic content) corresponding to a certain basic pitch and subsequent multiplication (addition in the logarithmic epression) of these waveshapes and does not require the same number of tone source devices as the number of system as in the formula (5).

Since the number of the basic content and the difference content is relatively few in a case where the number of system increases, e.g. 8 systems, 16 systems . . . , the number of tone source devices required is much smaller than the number of systems. For example, an eight system tone source effect can be realized with four tone sources and a 16 system tone source effect with five tone sources.

A preferred embodiment of the invention will be described with reference to the accompanying drawings.

DETAILED DESCRIPTION OF A PREFERRED EMBODIMENT

Figure 1:
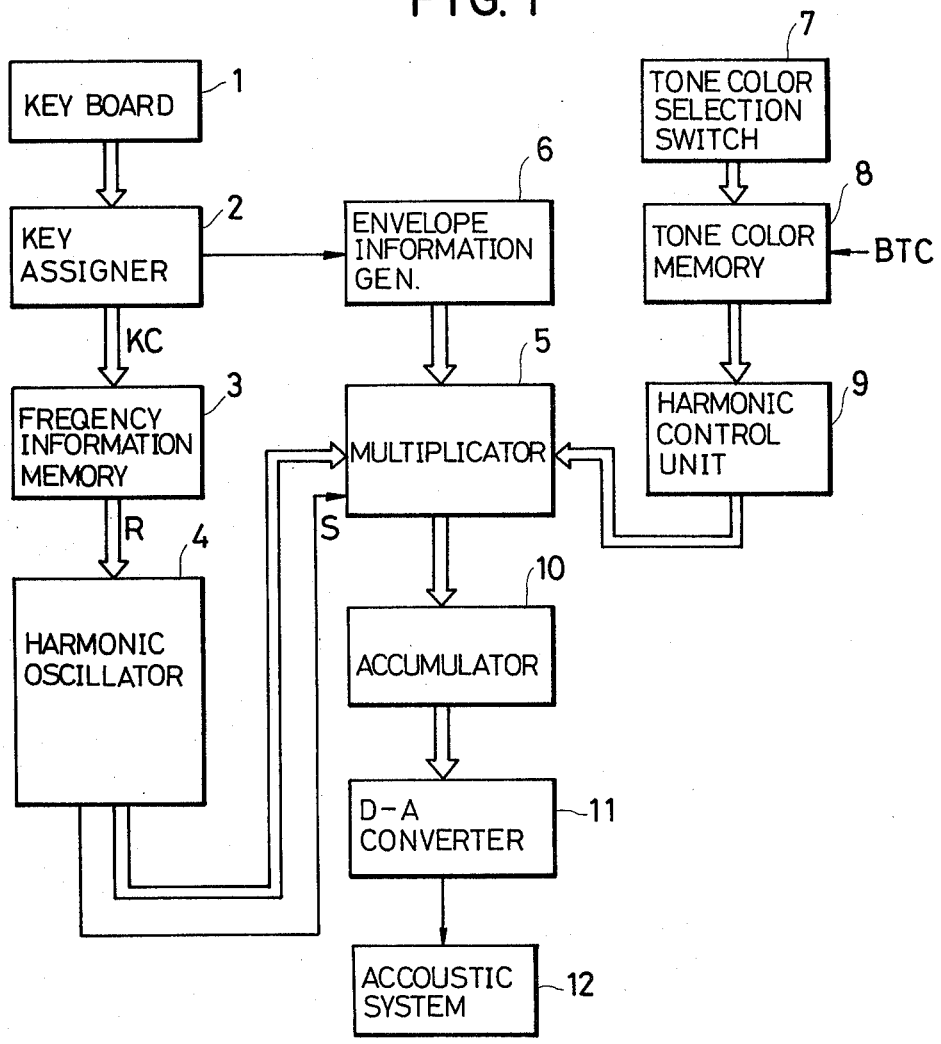
FIG. 1 is a block diagram schematically showing a preferred embodiment of the electronic musical instrument according to the invention.

FIG. 1 is block diagram schematically showing an entire construction of the electronic musical instrument according to the invention. The basic concept of the entire construction is to calculate amplitude values of respective harmonics of a musical tone waveshape to be reproduced at respective sample points with a regular time interval, multiply the amplitude values with amplitude coefficients of the respective harmonics characterizing the tone color of the musical tone and thereafter cumulatively add all the harmonic components to form the desired musical tone waveshape. This basic construction has already been described in a copending U.S. patent application Ser. No. 225,883, now U.S. Pat. No. 3,809,786, so that detailed description of the entire construction will be omitted and a harmonic oscillator 4 which constitutes an important feature of the present invention will be described in detail.

A key assigner 2 produces key address codes KC representing the key names of depressed keys in response to key-on information supplied from a keyboard circuit 1. These key address codes KC are allotted in a time sharing manner to respective channels corresponding to a maximum number of tones to be reproduced simultaneously and are read out sequentially and successively at each channel time. The key assigner also produces various clock pulses or time-shared information used for controlling time-shared synchronized operation of respective units constituting the instrument. Assume, for example, that the inventive electronic musical instrument uses higher harmonics up to the eighth harmonic and that a maximum number of tones to be reproduced simultaneously is eight. Clock pulses are counted by a first counter of eight stages (not shown) to form time sharing time slots for each harmonics and the frequency divided output of this counter is further counted by a second counter of eight stages (not shown) to form time sharing time slots for each of channels corresponding in number to the maximum number of tones to be reproduced simultaneously. The output of the first counter is hereinafter referred to as a order-of-harmonic signal BTC. This signal BTC is utilized for forming regular time interval of calculation required to produce the respective harmonic contents as will be described later.

A frequency information memory 3 previously stores frequency information R which is a value proportionate to the frequency of each tone. Frequency information R corresponding to the depressed key is read out in response to contents of key address code KC.

Figure 2:
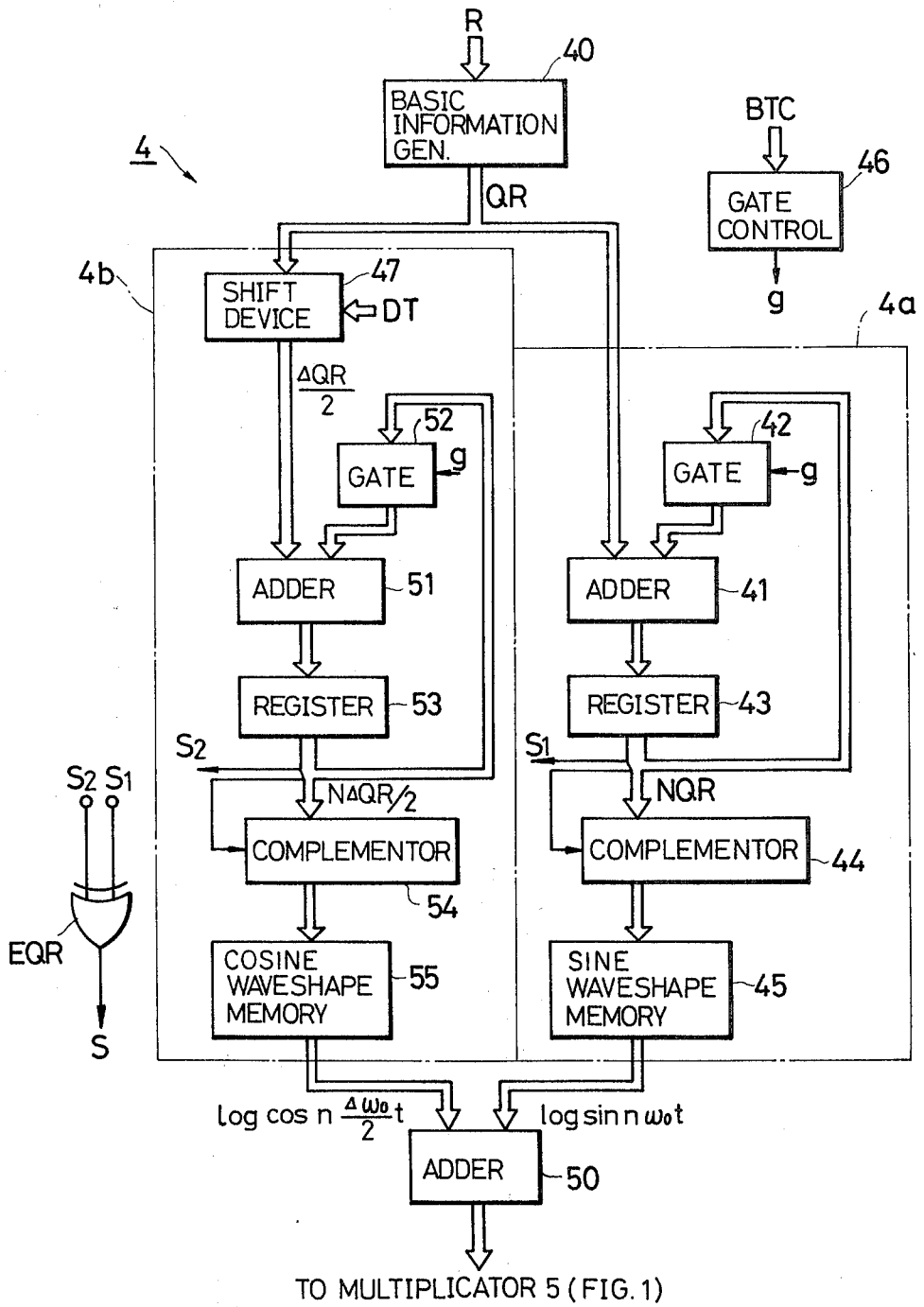
FIG. 2 is a block diagram showing an essential part of the electronic musical instrument shown in FIG. 1.

A harmonic oscillator 4 produces amplitudes at each phase of desired sine and cosine waves in accordance with the formula (3) or (6). FIG. 2 shows a specific example of such harmonic oscillator adapted to achieve the two system tone source effect as expressed by the formula (3).

A basic information generator 40 cumulatively counts with a certain interval (e.g. every 8 channel times) frequency information R read out in time sharing from the frequency information 3 at each channel time thereby forming basic information QR ($Q$=1, 2, 3 . . .) to be used for producing harmonic information. The phase of the fundamental wave is determined by this basic information. That is, the basic information QR corresponds to the phase $\omega_o t$. The basic information QR is generated in time sharing with respect to the eight tones (i.e. at each channel time).

The output QR of basic information generator 40 is applied to harmonic calculators 4a, 4b. The first harmonic calculator 4a performs calculation corresponding to the term of the logarithmically expressed sine wave, i.e. $\log \sin n\ \omega_o\ t$ (basic content) in the formula (3) and produces respective harmonics to the basic content. That is, the calculator 4a produces a fundamental frequency of the basic pitch and its harmonics. The second harmonic calculator 4b performs calculation corresponding to the term of the logarithmically expressed cosine wave, i.e.

$$\log \cos n \frac{\Delta\omega_o}{2} t$$

(difference content) in the formula (3) and produces respective harmonics of the cosine wave of the small angular velocity $\Delta\omega_o/2$ corresponding to the slight pitch difference to the basic pitch.

In the first harmonic calculator 4a, the basic information QR is sequentially and cumulatively counted at a high time sharing rate corresponding to the order-of-harmonic signal BTC and produces in time sharing harmonic information NQR ($N$=1, 2, . . .8) which constitutes address for respective sample points for reading out waveshape information of eight harmonics per tone (The eight harmonics includes fundamental wave). This determines phases of the respective harmonics. That is, the harmonic information NQR corresponds to the phase $n\omega_o t$ of the respective harmonics. Amplitudes at the respective sample points stored in a sine waveshape memory 45 are read out in response to the harmonic information NQR. A gate control unit 46 produces, upon receipt of the signal BTC, gate control pulse $g$ with an interval corresponding to the time sharing time slots of the respective harmonics. The result of addition (NQR) temporarily held in a register 43 is applied to one input of an adder 41 through a gate circuit 42 which is enabled with the interval of the gate control pulse $g$. In the adder 41, the basic information QR which is applied to another input thereof and a previous result of addition (NQR) are further added. Thus, the information QR is cumulatively added to produce the harmonic information NQR. Upon completion of one channel time (i.e. upon completion of the cumulative addition of all the harmonics), the gate control pulse $g$ is no longer generated. In a next channel time, cumulative addition of different basic information QR is performed in the adder 41.

The sine waveshape memory 45 digitally stores logarithmically expressed information of amplitudes at respective sample points (corresponding to phase NQR) of a quarter cycle of a sine waveshape. On the other hand, the cumulative addition for obtaining the information NQR is made until it has amounted to a phase of one cycle $2\pi$. That is, the information NQR returns to 0 every time it has amounted to a value corresponding to one cycle and the cumulative counting is repeated. Accordingly, distinction between a former half cycle (0) and a latter half cycle (1) of a waveshape is made in accordance with contents (0 or 1) of the most significant bit of the information held in the register 43. This information of the most significant bit is hereinafter referred to as a sign signal $S_1$. Further, distinction between a first quarter cycle (0) and a second quarter cycle (1) can be made in accordance with contents (0 or 1) of a bit which is one bit less significant than the most significant bit. For this purpose, the signal of this bit one bit less significant than the most significant bit is applied to a control input of a complementor 44 and the result of cumulative addition of the contents of bits which are less significant than this bit signal is applied to the complementor 44. When the control input signal of the complimentor 44 is 0, the harmonic information from the register 43 is directly applied to the sine waveshape memory 45 to be used as address for reading out a quarter cycle of the logarithmically expressed sine waveshape. When the control input signal is 1, complements of the respective harmonic information NQR are obtained and the information of such complements is used as address for reversely reading out the stored first quarter cycle of the waveshape amplitudes thereby to produce amplitudes forming a next quarter cycle of the waveshape. The logarithmically expressed sine wave shape amplitude information log sin $n\ \omega_o t$ can be substantially obtained in the foregoing manner. Actually, the amplitudes corresponding to the former half cycle of the waveshape are repeatedly read out and the sign is inverted in the latter half cycle in a harmonic coefficient multiplicator 5 to be described later in accordance with the sign signal $S_1$ for producing a normal waveshape.

The second harmonic calculator 4 is of a similar construction to the first harmonic calculator 4a but it additionally comprises a shift device 47 for forming small angular velocity information ΔQR/2 required for producing slight pitch difference. The shift device 47 produces the small angular velocity information ΔOR/2 by shifting down the basic information QR by a predetermined bit number. This information ΔQR/2 corresponds to the phase $$\frac{\Delta\omega_o}{2}t$$

of the cosine wave due to the small angular velocity. For example, the basic information QR is shifted down by 7 bits to cause the information ΔQR/2 to become $$\frac{1}{128}QR.$$

A pitch difference control signal DT is information consisting of a suitable number of bits, e.g. 2 bits. This information is used for minutely adjusting the amount of shift for controlling the pitch difference as desired. For example, ΔQR/2 remains at $$\frac{1}{128}QR$$

in a case where the signal DT is 00. If the signal DT is 01, the information ΔQR/2 is further shifted by one bit towards less significant bits to become $$\frac{1}{256}QR.$$

The small angular velocity information ΔQR/2 is applied to an adder 51 where it is added to a previous result of addition supplied from a gate circuit 52. The output result of addition from the adder 51 is applied to a register 53 and held temporarily therein. The gate circuit 52 receives the gate control pulse $g$. In the same manner as has been described with respect to the first harmonic calculator 4a, the small angular velocity information ΔQR/2 is cumulatively counted in the second harmonic calculator 4b in synchronization with the cumulative counting of the information QR in the first harmonic counter 4a to produce information NΔQR/2 ($N$ = 1, 2 . . .8) of phases of the respective harmonics included in the difference content. This information NΔQR/2 corresponds to the phase $$\frac{n\Delta\omega}{2}t \text{ of } \cos n\ \frac{\Delta\omega}{2}t$$

in the formula (3). For the same reason as described above, a sign signal $S_2$ is used and a complementor 54 is provided.

A cosine waveshape memory 55 digitally stores logarithmically expresed amplitudes at respective sample points of a quarter cycle of a cosine wave and substantially produces logarithmically expressed cosine waveshape amplitude information $$\log \cos n \frac{\Delta\omega_o}{2} t.$$

The amplitude information read from the memories 45 and 55 which is synchronous with each other by each of the harmonics of the respective tones to be reproduced simultaneous is applied simultaneously to an adder 50 at each harmonic time to enable the adder 50 to perform addition log sin $$n\omega_o t + \log \cos n \frac{\Delta\omega_o}{2} t.$$

The result of the addition in the adder 50 which represents a composite amplitude value of the respective systems for achieving the multi-system tone source effect is supplied to the harmonic coefficient multiplicator 5 shown in FIG. 5. The sign signals $S_1$, $S_2$ are applied to an exclusive OR circuit EOR and a synthesized signal S is supplied to the harmonic coefficient multiplicator 5.

An envelope information generator 6 generates in a time sharing manner envelope control information including attack, decay sustain and release by each of the tones to be reproduced simultaneously i.e. every channel time in response to the key-on and key-off information from the key assigner 2. This envelope control information may conveniently be expressed in a logarithmic form.

A tone color memory 8 previously stores amplitude coefficients (level information of the respective harmonic contents realizing various tone colors and provides, in response to the order-of-harmonic signal BTC, amplitude coefficient (level) information on harmonic components corresponding to a tone color selected by operation of a tone color selection switch 7 in time shared sequence by each of the harmonics. A harmonic control unit 9 performs control functions including modulation of the read out coefficient information of the respective harmonics and selection of the coefficient information for obtaining different tone colors according to the kind of keyboard, supplying in time sharing the coefficient information of the respective harmonics (including a fundamental wave) to the multiplicator 5. This amplitude coefficient information also may conveniently be expressed in a logarithmic form.

In the multiplicator 5, amplitude coefficient information An of the harmonics of the respective orders in the formula (3) is first obtained by multiplying level information of the respective harmonic components for realizing a desired tone color supplied from the harmonic control unit 9 with the envelope control information controlling an entire envelope (change in volume) of a particular tone. If, accordingly, both information is expressed in a logarithmic form, a logarithmically expressed coefficient information log An can be obtained by adding both information together. In the multiplicator 5, this coefficient information log An is further added to two system tone source waveshape amplitude information $$\log \sin n\,\omega_o t + \log \cos n \frac{\Delta\omega_o}{2} t$$

supplied from the harmonic oscillator 4 thereby carrying out the formula (3). Thus, waveshape amplitude information X*c* characterized in its tone color and envelope produced in time sharing for each harmonic component. The logarithmically expressed information log X*c* is converted to linear information X*c* in the multiplicator 5. Further, since the information of the half cycle waveshape is not inverted yet, the amplitude information which has now been converted to linear information is inverted in response to the sign signal S to form perfect waveshape amplitude information. Since log 2 in the formula (3) is a constant and contributes only to increasing the amount of attenuation, this is not included in calculation. The waveshape amplitude information X*c* of the respective harmonics produced in this manner is applied to an accumulator 10. The accumulator 10 adds the waveshape amplitude information X*c* from the fundamental wave to the eighth (*n*-th) harmonic together to produce a single musical tone waveshape amplitude. If desired, amplitudes of the respective tones may be added together by the kind of keyboard. The musical tone waveshape amplitude information of the composite harmonic contents is applied to a digital-analog converter 11 where it is converted to an analog waveshape signal and thereafter is sounded through an accoustic system 12.

The above description has been made about the two system tone source effect. It will, however, be understood that a similar construction can be employed for producing other multi-system tone source effect. More specifically a desired multi-system tone source effect can be produced by constructing the harmonic oscillator 4 on the basis of a formula obtained by reducing terms of the basic formula (i.e. increasing the number of harmonic calculators in accordance with the sine function term (i.e. basic content) and the cosine function term (i.e. difference content)). For example, a four system tone source effect can be produced by providing three kinds of tone sources (i.e. harmonic calculators 4*a*, 4*b* and 4*c*) on the basis of the formula (4) or (6). If the tone source device is constructed on the basis of a linearly expressed equation such as the formula (1) or (4), it requires a somewhat complicated digital multiplicator though the number of the basic content and difference content is the same as in the case of the logarithmically expressed equation (3) or (6). For this reason, it will be more convenient if amplitudes at the respective sample points of waveshapes stored in the sine and cosine waveshape memories are stored in a logarithmic form because this arrangement will enable utilization of an adder which is much simpler in construction than a multiplicator.

As described in the foregoing, the present invention is capable of realizing a multi-system tone source effect with a smaller number of tone sources than the number of the systems, so that component parts can be saved with resulting reduction in the cost of manufacture.

In a case where the multi-system tone source effect is not required, a normal tone of a constant pitch can be produced merely by cutting off the outputs of unnecessary tone sources and using the output of a tone source for the normal, constant pitch (i.e. harmonic calculator 4*a*). This is another advantage of the invention because according to the prior art device in which a tone source is provided in each of the systems to carry out the formula (2), an extra tone source must be provided for producing a normal tone of a constant pitch and this will make the entire device more complicated and bulky.

What is claimed is:

1. An electronic musical instrument of a type wherein amplitudes at sequential sample points of a musical tone waveshape are calculated by sequentially and successively calculating amplitudes of respective harmonic components at each of the sample points with a regular time interval and cumulatively adding the amplitudes of the respective harmonic components comprising:

a first harmonic calculator for sequentially calculating, with said regular time interval, amplitudes of respective harmonic components of a sine wave function basic content corresponding to a basic pitch of a composite musical tone waveshape which is composed of the tone of the basic pitch and one or more tones which are slightly different in pitch from the tone of the basic pitch and is represented by a single multiplication term of said basic content and a cosine wave function difference content corresponding to the pitch difference;

one or more second harmonic calculators provided in accordance with the number of said difference contents for sequentially and successively calculating, with said regular time interval, amplitudes of respective harmonic components of said difference content in said composite musical tone waveshape amplitudes; and means for sequentially synthesizing said respective harmonic components amplitudes from said first and second harmonic calculators;

composite amplitudes of said basic content and said difference content by each order of harmonic being sequentially produced with said regular time interval and said composite amplitudes being cumulatively added for producing said composite musical tone waveshape amplitudes.

2. An electronic musical instrument as defined in claim 1 wherein said first harmonic calculator calculates log sin $n\ \omega_0 t$ (where $n$ represents order of the harmonic, $\omega_0$ angular velocity of fundamental frequency) and said second harmonic calculator calculates $$\log \cos n \frac{\Delta\omega_0}{2} t.$$

3. An electronic musical instrument as defined in claim 1 wherein said first harmonic calculator calculates log sin $n\ \omega_0 t$ and said second harmonic calculator calculates $$\log \cos n \frac{3\Delta\omega_0}{8} t + \log \cos n \frac{\Delta\omega_0}{8} t.$$

4. An electronic musical instrument as defined in claim 2 wherein said first harmonic calculator calculating log sin $n\ \omega_0 t$ comprises an accumulator for cumulatively adding information QR corresponding to the phase $\omega_0 t$ with said regular time interval and a sine waveshape memory which stores a sine waveshape in a logarithmic form and is addressed by results of the cumulative addition to provide amplitudes of the sine waveshape at sample points corresponding to the results of the cumulative addition, and said second harmonic calculator calculating $$\log \cos n \frac{\Delta\omega_0}{2} t$$

comprises a shift device for producing information $\Delta QR/2$ by suitably shifting the information QR, an accumulator for cumulatively adding the information $\Delta QR/2$ with said regular time interval and a cosine waveshape memory which stores a cosine waveshape in a logarithmic form and is addressed by the results of the cumulative addition to provide amplitudes of the cosine waveshape at sample points corresponding to the results of the cumulative addition.

* * * * *